United States Patent [19]

Culling

[11] Patent Number: 4,836,985

[45] Date of Patent: Jun. 6, 1989

[54] NI-CR-FE CORROSION RESISTANT ALLOY

[75] Inventor: John H. Culling, St. Louis, Mo.

[73] Assignee: Carondelet Foundry Company, St. Louis, Mo.

[21] Appl. No.: 234,815

[22] Filed: Aug. 19, 1988

[51] Int. Cl.[4] ..... C22C 30/02

[52] U.S. Cl. ..... 420/582; 420/586

[58] Field of Search ..... 420/582, 586.1

[56] References Cited

U.S. PATENT DOCUMENTS

| | | | |
|---|---|---|---|
| 1,115,239 | 10/1914 | Parr | 420/450 |
| 2,103,855 | 12/1937 | LaBour | 420/453 |
| 2,597,495 | 5/1952 | Jackson et al. | 420/453 |
| 2,938,786 | 5/1960 | Johnson | 420/453 |
| 2,938,787 | 5/1960 | Boyd et al. | 420/453 |
| 3,008,822 | 11/1961 | Boyd et al. | 420/453 |
| 3,758,296 | 7/1973 | Johnson | 420/582 |
| 4,765,957 | 8/1988 | Culling | 420/582 |

*Primary Examiner*—L. Dewayne Rutledge

*Assistant Examiner*—David W. Schomaker

*Attorney, Agent, or Firm*—Senniger, Powers, Leavitt & Roedel

[57] ABSTRACT

The present invention is directed to air-meltable, castable, weldable, machinable alloys of reasonable ductility and resistance to very hot concentrated sulfuric acid as well as to most other more dilute strengths of the acid either in the pure acid-water forms or containing additionally contaminants that might be encountered in practical applications. The alloys consist essentially of between about 36% and about 40.5% by weight nickel, from about 31% to about 33% by weight chromium, from about 4% to about 5.2% by weight molybdenum, from about 2.7% to about 4% by weight copper, from about 2.5% to about 6% by weight silicon, from about 0.40% to about 0.62% by weight nitrogen and the balance essentially iron. The instant alloys may also contain up to about 2% by weight manganese and up to 0.11% by weight carbon.

6 Claims, No Drawings

NI-CR-FE CORROSION RESISTANT ALLOY

This invention relates to corrosion resistant alloys, which can be formulated from ferro-alloys, having good corrosion resistance to very hot concentrated sulfuric acid.

BACKGROUND OF THE INVENTION

Sulfuric acid is the largest volume inorganic acid currently in use and is generally considered to be the most important industrial chemical. Cold diluted sulfuric acid may be readily handled in most situations. On the other hand, the production and handling of hot concentrated sulfuric acid presents rather specialized problems in the field of corrosion.

The hallmark of alloys based upon the addition of large amounts of chromium to iron, nickel or some combination of iron and nickel is the remarkable resistance of the resultant alloys to oxidizing chemical substances when oxygen is present in some available form.

In modern usage an agent that will cause metallic atoms to lose electrons is called an oxidizing agent. The loss of electrons by atoms is considered to be oxidation, so that metals and alloys may be "oxidized" by substances that contain no oxygen at all because they remove electrons from the metals.

It is the property of the chromium-bearing alloys in the presence of available oxygen to somehow readily and quickly form a protective or passive surface against further attack. If this passive surface is disturbed or disrupted under these conditions it will quickly repair itself or repassivate. In the absence of oxygen these alloys are ordinarily not able to become passive or to regain passivity on a disrupted surface.

Hot concentrated sulfuric acid does not ordinarily contain sufficient dissolved oxygen to passivate alloys of chromium which contain various proportions of nickel and iron. However, it has been learned over the years that higher proportions of nickel in such alloys are beneficial in establishing passivity in hot concentrated sulfuric acid. Also, copper, molybdenum and silicon are additional elements that tend to passivate chromium-bearing alloys in hot concentrated sulfuric acid, so that the resultant alloys, with suitable proportions of these various elements, may be quite resistant to this very corrosive substance.

The presence of 14% to 17% silicon and a few percent of molybdenum or copper in iron result in alloys that are quite resistant to hot concentrated sulfuric acid and low in strategic element content. However, because silicon is a non-metallic element, these high-silicon alloys are even more brittle than glass and hence of very limited application. There is a parallel situation when about 8% to 10% silicon and a few percent of copper are added to nickel. This alloy is a bit less brittle, quite resistant to the acid, much higher in cost, and again, of very limited application.

Glasses are also generally quite resistant to sulfuric acid but ordinarily limited in their use to the packaging and transportation of fairly small quantities of cold acid of the order of a gallon or a liter. This is due to the pronounced susceptibility of glasses to cracking or shattering by either a structural strain or blow or by a sudden change of temperature.

Lead is also resistant but is limited in employment as a sheathing or lining material because lead has extremely low structural strength.

Also, a few precious elements, such as platinum, are quite resistant to hot concentrated sulfuric acid but are so scarce that their extensive use in commercial acid production and handling is quite out of the question.

Furthermore, some industrial streams of hot concentrated sulfuric acid solutions may contain sludges or particulate matter and/or free air or vapor bubbles. Either of these conditions may lead to severe erosion problems in addition to chemical attack. It is for this reason that many alloys developed for the handling of hot concentrated sulfuric acid are also relatively hard even at the expense of giving up toughness, ductility, fabricability and weldability. However, those properties are usually so important that a compromise is almost always desirable.

Samuel Parr disclosed in 1914, in U.S. Pat. No. 1,115,239, an alloy of about 63% nickel, 20% chromium, 5% molybdneum, 5% copper and 2% tungsten, in which small quantities of iron, silicon, mangenese, titanium, boron and aluminum may also be present. This alloy had useful resistance to hot sulfuric acid as well as to several other acids and chemical substances and could be easily air melted, cast, forged and drawn.

It wasn't until 1937 that LaBour, U.S. Pat. No. 2,103,855, revealed a similar alloy which typically contained the major elements of Parr Plus about 4% silicon and up to about 8% iron. The alloy of LaBour had relatively good resistance to the corrosion of hot solutions of many substances including sulfuric acid but was hampered by relatively high carbon contents of about 0.2 to 0.3%. LaBour also represented the first reported such alloy to give up toughness for hardness.

Then in 1952, Jackson, in U.S. Pat. No. 2,597,495, disclosed an alloy intended for improved fabricability. The alloy of Jackson was, in some respects, a combination of the alloys of Parr and LaBour but of lower carbon and copper contents with the elimination of tungsten. However, Jackson's alloys were of even lower resistance to hot concentrated sulfuric acid.

The mechanical properties of alloys-pendulum then swung back in the hard-brittle direction with the issuance in 1960 of patents to Johnson, U.S. Pat. No. 2,938,786, and to Boyd, Langton and Johnson, U.S. Pat. No. 2,938,787. Both patents provided for silicon contents up to about 6% or 7% plus additions of boron up to about 0.55%. Jackson '786 allowed slightly higher iron additions and essentially covered chromium levels below 26%, while the '787 patent covered chromium levels from 26% to 30% and permitted an iron content to only 3.5%.

For the higher-silicon variations of both of these alloys, resistance to concentrated sulfuric acid up to 100° C. is quite good. The corrosion resistance of both alloys to hot concentrated acid deteriorates rapidly, however, when the silicon content drops much below about 5%. And, as is the usual case, brittleness and extreme lack of fabricability, workability and weldability remain as characteristics of the alloys with the higher-silicon contents that are so resistant to the corrosive effects of the hot acid. Also, as with the other alloys described above, these alloys are characterized by having to be formulated from relatively pure raw materials due to their low permissible iron levels.

In both U.S. Pat. Nos. 2,938,786 and 2,938,787 it is stated that the addition of the non-metallic element boron when added with the non-metallic element silicon in certain prescribed proportions, actually improves mechanical properties without sacrificing corrosion resistance or hardness. Nonetheless, the alloys of those patents are quite brittle even though they have excellent corrosion resistance to hot concentrated sulfuric acid, especially when silicon contents approach the 6% to 6.5% levels. In industrial applications these alloys are usually furnished at the 3.5% silicon level with some sacrifice in corrosion resistance in order to gain at least some reduction in brittleness. But, since the iron content has to be held to very low proportions, the resultant alloys have to be formed from relatively pure sources of chromium, molybdenum, silicon and nickel. Nickel and silicon are ordinarily available in the pure or concentrated form, but chromium and molybdenum are much more costly and difficult to employ in air melting practice as pure elements than they are when usable as ferro-alloys.

Boyd, Langton and Johnson also disclosed a third sulfuric acid-resistant alloy in U.S. Pat. No. 3,008,822, in 1961, which was designed to provide sufficient fabricability to afford rolled or wrought forms. This was essentially a low-silicon, boron-free version of the alloy of U.S. Pat. No. 2,938,787. The alloy was fairly tough and fabricable but not nearly as resistant to hot concentrated sulfuric acid as are the high-silicon versions. Also, only 1.5% iron or less can be tolerated, requiring that the alloy be formulated from high-purity forms of the constituent elements.

Still later, in 1973, Johnson, in U.S. Pat. No. 3,758,296, discloses an alloy of higher chromium content along with somewhat lower molybdenum and copper levels. This alloy was stated to be able to tolerate high iron contents, permitting the use of ferro-alloys in place of pure chromium and molybdenum. The alloy also provided for somewhat reduced nickel contents but in so doing employed relatively high manganese contents plus the inclusion of the scarce and expensive element cobalt. This alloy retained the amount of boron at levels reduced from prior patents along with silicon contents of 4% or less. The alloy is said to have good resistance to hot concentrated sulfuric acid when its constituent elements are present in optimum proportions, but it is so brittle that it is extremely difficult to cast without cracking and does not possess weldability by any ordinary methods.

However, the commercial alloys of Johnson (U.S. Pat. No. 3,758,296) are relatively unstable in metallurgical structure. They show some slight tensile elongation if cast into rather small castings or thin sections, but display extreme brittleness when cast into heavier sections. That patent provides for nickel contents to 48%, but the alloys then require iron contents of 3% or less. Use of ferro-alloys is no longer possible.

But aside from that, the highest nickel content Johnson alloys are still hard and brittle and suffer drastic loss of resistance to hot concentrated sulfuric acid corrosion. The nickel-equivalency of the Johnson alloys range from about 33% to 43.7%, excluding manganese and copper, whose effects are minor but including the estimated effects of carbon. The commercially employed Johnson alloy has about 40% to 41% nickel-equivalency based upon the same constituent elements. The commercial alloy has a chromium equivalency of about 49%. Metallugically this would require about 50% or higher nickel-equivalency to maintain a fairly stable austenitic matrix. Since the Johnson alloys do not meet this balance, they tend to have very unstable matrices resulting in very hard and brittle castings unless they are produced in only very thin cross sections or are solution heat treated for about four hours at the relatively high temperature of about 2050° F. This is near the incipient fusion temperature of about 2100° F. and is, therefore, a difficult and costly heat treatment which results in irreversible casting damage if the heat-treating furnace controls are slightly out of calibration.

From the foregoing it is evident that a commercially useful alloy of high enough ductility to be fabricable in sheets, tubes, etc., and still resistant to very hot concentrated sulfuric acid would be most desirable. The problem has been, however, that such an alloy has not been forthcoming because of the apparent need for large proportions of chromium, molybdenum, and silicon, combined with copper as well as high nickel levels, and, usually, low levels of iron. Nevertheless, it is still desirable to have a castable alloy of at least modest tensile elongation that has good resistance to hot concentrated sulfuric acid and still capable of being formulated with ferro-alloys and ordinary air-melting equipment. It is also desirable that such an alloy may be hardenable after machining in order to better resist the erosion encountered in services that involve contact with particulate matter or vapor bubbles.

Thus the prior art alloys for handling hot concentrated sulfuric acid have been encumbered with the same problem. The chromium, molybdenum and silicon levels required for corrosion purposes have simply tended to be too high to be structurally offset by nickel even when nickel is at the highest level possible.

SUMMARY OF THE INVENTION

Among the several objects of the present invention, therefore, may be noted the provision of improved alloys resistant to hot concentrated sulfuric acid solution, either pure or containing contaminants; the provision of such alloys which are structurally relatively stable so that they also have good mechanical properties; the provision of such alloys which may be easily hardened when desirable by a simple heat treatment; the provision of such alloys which may be economically formulated from ferro-alloys; and the provision of such alloys which may be readily air melted and cast into simple or complex shapes.

Briefly, therefore, the present invention is directed to air-meltable, castable, weldable, machinable alloys of reasonable ductility and resistance to very hot concentrated sulfuric acid as well as to most other more dilute strengths of the acid either in the pure acid-water forms or containing additionally contaminants that might be encountered in practical applications. The alloys consist essentially of between about 36% and about 40.5% by weight nickel, from about 31% to about 33% by weight chromium, from about 4% to about 5.2% by weight molybdenum, from about 2.7% to about 4% by weight copper, from about 2.5% to about 6% by weight silicon, from about 0.40% to about 0.62% by weight nitrogen and the balance essentially iron. The instant alloys may also contain up to about 2% by weight manganese and up to 0.11% by weight carbon.

DESCRIPTION OF THE PREFERRED EMBODIMENT

In accordance with the present invention, alloys are provided which have resistance to hot concentrated pure or contaminated sulfuric acid that are equal or superior to prior metallic alloys. The alloys of the invention are air-meltable and air-castable into simple or complex shapes, and are weldable, machinable and hardenable.

In contrast to the prior art nickel-base alloys having almost no tolerance for iron, the alloys of the present invention may contain up to about 23% iron, preferably from about 15% to about 23.1% by weight of iron, and thus may be formulated using ferro-alloys instead of essentially iron-free raw materials. In addition, unlike the high chromium prior art alloys, as represented by Johnson, U.S. Pat. No. 3,758,296, which could also be formulated using ferro-alloys, the alloys of the present invention are metallugically stable, contain no intentionally added scarce and expensive cobalt, and have sufficient tensile elongation and ductility to be machinable and weldable and are not subject to the easy thermal or mechanical cracking associated with the prior alloys.

By comparison to the high silicon content alloys of the prior art, which were developed to provide alloys having corrosion resistance to hot concentrated sulfuric acid, the alloys of this invention have much lower silicon concentrations. Thus alloys of this invention show continuous improvement in resistance to very hot concentrated sulfuric acid as silicon is increased to 6%, but as the maximum silicon content is approached they also evidence increased brittleness. A 3.5% to 4% silicon level is therefore more desirable where conditions permit its use, and at those levels of silicon the alloys of this invention are still more resistant to hot sulfuric acid than prior art alloys.

Over the narrow ranges of constituent elements of the alloys of this invention the effect upon matrix metallurgical structure of a change of 1% silicon by weight is approximately equal to a change of 2% molybdenum or 3% chromium. Each of these elements tend to promote ferritic or other non-austenitic matrix structures at or near room temperatures.

Contrariwise, nickel, cobalt, copper and nitrogen all tend to produce an austenitic, or face-centered-cubic, crystal matrix structure at room temperature. Manganese has properties that tend in ways to promote both austenitic and non-austenitic structures in the presence of the other elements in the quantities present in these alloys. In the instant alloys the direct effect of manganese upon matrix structure is weak in any event, but manganese strongly increases the solid solubility of nitrogen in the final alloys, which already have a high solubility for nitrogen at the chromium levels present. In alloys of the present invention it has also been found desirable to limit the manganese content in order to achieve and maintain moderate ductility.

Cobalt tends to produce a close-packed-hexagonal crystal matrix structure in cobalt-base alloys but is approximately equivalent to nickel on a weight percent basis in promoting the austenitic structure in the alloys of the present invention. However, it has been found that cobalt tends to promote hardening and reduce ductility. Not only is cobalt not metallurgically desirable in the alloys of this invention, it is also a much scarcer and more expensive element than nickel. In alloys of this invention therefore it is desirable to limit cobalt content to the amount found in nickel ores such as encountered in Canadian deposits. In any event, cobalt should not exceed about 1.2% in alloys of this invention.

While copper is an extremely important and necessary element in alloys of this invention because of its beneficial effects upon corrosion resistance, it is only a very mild promoter of the austenitic matrix structure. Copper should therefore be present at about 2.7% to about 4% by weight.

Nitrogen and carbon are also both very powerful austenite stabilizers, but carbon must be limited for corrosion purposes. So nitrogen is a most important element to alloys of this invention for structural balance against the hardening and enbrittling effects of chromium, molybdenum and silicon. Nitrogen has been reported by various investigators as being approximately thirty times as strong as nickel on a weight basis as an austenite stabilizer. In alloys of this invention I have found it to be more like twenty four times. That is, 0.04% nitrogen is approximately equal to 1% nickel, or 0.5% nitrogen is about equal to 12% nickel in its ability to stabilize the austenitic matrix structure. Of course for sound castings in ingots, the amount of nitrogen must not exceed the limits for solid solubility. In this invention that limit is about 0.62%. It is not possible in alloys of such large proportions of ferritizing elements to maintain a structure of uniform solid solution of austenite at or near room temperatures. While formation of an additional matrix phase of ferrite would not result in excessive brittleness, the large proportions of ferrite-forming elements actually tend to produce martensite, sigma, chi, silicides or other vary brittle additional phases. The actual quantities and morphologies of these additional phases in such alloys is dependent upon thermal history and section size. Increased proportions of these phases result in drastically increased brittleness. Nitrogen in alloys of the present invention retards the formation of these brittle phases, particularly the chromium-molybdenum sigma phase, but brittle silicides will still form at higher silicon levels.

The preferred alloys of the present invention have a chromium-equivalency of about 40% and, therefore, require a 50% or higher nickel-equivalency, obtained by relatively large additions of nitrogen. This results in much greater ease of casting production, such that a solution heat treatment is not ordinarily required for the preferred embodiments prior to machining and use.

When hardening is desirable it may be readily achieved by a simple moderate heat treatment of holding a casting for two to four hours at about 1500° F. The resultant hardness will fall in the 370 to 420 Brinell hardness number (BHN) range, depending upon exact composition. During this heat treatment some of the austenite decomposes into nitrides plus other matrix phases.

Thus the primary components of the alloy of the invention are:

| | |
|---|---|
| Nickel | 36–40.5% by weight |
| Chromium | 31–33% |
| Molybdenum | 4–5.2% |
| Copper | 2.7–4% |
| Silicon | 2.5–6% |
| Nitrogen | 0.4–0.62% |
| Iron | Essentially balance |

The content by weight of nickel is understood to include a small amount of its sister element, cobalt, which as mentioned above, naturally occurs in certain ore deposits. However, the partial substitution of cobalt for nickel must not exceed about 1.2% by weight cobalt.

Nominally the alloys of the invention will also contain carbon, up to a maximum of about 0.11% by weight and manganese up to about 2% by weight. Titanium, columbium, and tantalum are widely employed in corrosion-resistant alloys to provide immunity to intergranular corrosion when carbon contents exceed about 0.02% or 0.03%. However, the alloys of this invention do not suffer intergranular corrosion despite their relatively high carbon contents. Since titanium, columbium, and tantalum are each powerful ferritizers, their presence in alloys of this invention is not desirable due to the presence of the other required ferritizers, chromium, molybdenum and silicon, in such relatively large quantities. They are, therefore, limited in alloys of the present invention to a combined content of no more than about 0.5% by weight as may possibly be absorbed as contaminants from undesirable sources.

Tungsten may be encountered in certain sources of molybdenum-bearing scraps and may be tolerated in the present invention up to about 0.7% by weight, if titanium, columbium and tantalum are not also concurrently encountered in amounts beyond traces. Tungsten is also a ferritizer, roughly equivalent to chromium in that respect and, therefore, is slightly more tolerable than titanium, columbium and tantalum.

Manganese is widely employed as a deoxidizer in ordinary steel making practices in amounts up to about 2% by weight. It is also employed up to very much larger proportions in certain special alloys. However, in alloys of the present invention manganese is restricted to a maximum content of about 2% by weight. With the presence in the alloys of such large amounts of the deoxidizing elements chromium, silicon and molybdenum, there is no real need for the addition of a further deoxidizer such as manganese. Manganese is, however, includable as an extra safety precaution and in fact, may be difficult to exclude since it is a widely encountered element in steel and other scraps. Manganese may therefore be present in a nominal amount of up to about 2% by weight.

It has been found preferable to restrict the ranges of the elements in the alloy of the present invention to the following:

| | |
|---|---|
| Nickel | 36–40.5 by weight |
| Chromium | 31–32.5% |
| Molybdenum | 4–5% |
| Copper | 2.7–4.0% |
| Silicon | 3–4.3% |
| Nitrogen | 0.5–0.6% |
| Carbon | 0.09% maximum |
| Manganese | 1.5% maximum |
| Cobalt | 1.1% maximum |
| Iron | 15–23.1% |

For excellent balance between mechanical and corrosion properties it has been found desirable to further restrict the alloy of the invention to the following ranges of elements:

| | |
|---|---|
| Nickel | 36–39% by weight |
| Chromium | 31–32.5% |
| Molybdenum | 4–5% |
| Copper | 3–4% |
| Silicon | 3.2–3.9% |
| Nitrogen | 0.5–0.6% |
| Carbon | 0.09% maximum |
| Manganese | 0.2–1% |
| Cobalt | 1.1% maximum |
| Iron | 17–22.1% |

On the other hand, for an optimum balance of properties and ease of formulation an% handling it has been found preferable to even further restrict the alloy to the following ranges:

| | |
|---|---|
| Nickel | 36.5–38.5% by weight |
| Chromium | 31–32% |
| Molybdenum | 4–5% |
| Copper | 3–3.5% |
| Silicon | 3.4–3.7% |
| Nitrogen | 0.5–0/6% |
| Carbon | 0.08% maximum |
| Manganese | 0.3–0.8% |
| Cobalt | 1% maximum |
| Iron | 17–21.3% |

Within the ranges of the elements of the alloys of this invention a particularly advantageous formulation having optimum chemical, physical, mechanical, and metallurgical properties has the following compositions:

| | |
|---|---|
| Nickel | 37.5% by weight |
| Chromium | 31.5% |
| Molybdenum | 4.5% |
| Copper | 3.1% |
| Silicon | 3.55% |
| Nitrogen | 0.55% |
| Carbon | 0.05% |
| Manganese | 0.5% |
| Iron | Essentially balanced |

The following examples further illustrate the invention.

EXAMPLE 1

One hundred pound heats of several different compositions were prepared in accordance with the invention. Each of the heats was air-melted in a 100-pound high frequency induction furnace. The compositions of these heats are set forth in Table I, the balance in each instance being essentially iron. Compositions of comparative alloys are also set forth in Table I with the balance being essentially iron.

TABLE I

| ALLOY DESIGNATION | PERCENT BY WEIGHT OF ALLOYING ELEMENTS | | | | | | | | |
|---|---|---|---|---|---|---|---|---|---|
| | Ni | Cr | Mo | Cu | Si | Mn | N | C | Co |
| 1430 | 40.25 | 32.05 | 4.02 | 3.11 | 2.76 | 1.37 | 0.51 | 0.01 | — |
| 1431 | 39.21 | 31.15 | 4.13 | 3.04 | 3.33 | 1.34 | 0.48 | 0.02 | — |
| 1437 | 37.88 | 32.44 | 4.51 | 3.12 | 5.97 | 1.20 | 0.53 | 0.02 | — |
| 1438 | 38.03 | 32.31 | 4.88 | 3.02 | 4.29 | 0.66 | 0.49 | 0.11 | — |
| 1439 | 36.88 | 31.16 | 4.95 | 3.55 | 5.03 | 0.29 | 0.41 | 0.06 | — |
| 1441 | 37.44 | 31.89 | 4.02 | 3.27 | 3.48 | 0.73 | 0.53 | 0.05 | — |
| 1451 | 37.23 | 31.33 | 4.48 | 3.09 | 3.57 | 0.48 | 0.56 | 0.09 | — |
| 1452 | 36.89 | 31.45 | 4.78 | 3.40 | 3.40 | 0.49 | 0.54 | 0.04 | — |
| Illium 98 | 54.86 | 28.11 | 8.48 | 5.51 | 0.68 | 1.23 | — | 0.05 | — |
| Illium B* | 49.84 | 27.98 | 8.51 | 5.49 | 3.52 | 1.19 | — | 0.05 | — |

TABLE I-continued

| ALLOY DESIGNATION | PERCENT BY WEIGHT OF ALLOYING ELEMENTS | | | | | | | | |
|---|---|---|---|---|---|---|---|---|---|
| | Ni | Cr | Mo | Cu | Si | Mn | N | C | Co |
| 3,758,296* | 33.56 | 32.04 | 4.71 | 2.88 | 3.66 | 2.85 | — | 0.08 | 6.02 |

*0.05% Boron was added to 3,758,296 and 0.5% Boron to Illium B.

Standard physical test blocks and corrosion test bars were prepared from each heat. Using the as-cast non-heat treated physical test blocks standard tensile test bars from each heat were machined and the mechanical properties of each were measured The results of these measurements are set forth in Table II.

TABLE II

MECHANICAL PROPERTIES OF ALLOYS OF THE INVENTION AND OF COMPARATIVE ALLOYS

| ALLOY DESIGNATION | TENSILE STRENGTH P.S.I | YIELD STRENGTH P.S.I. | TENSILE ELONGATION % | BRINELL HARDNESS NUMBER |
|---|---|---|---|---|
| 1430 | 66,670 | 61,800 | 4.5 | 196 |
| 1431 | 53,880 | 46,900 | 4.0 | 188 |
| 1437 | 74,900 | No Yield | 0 | 355 |
| 1438 | 64,800 | 62,770 | 1.5 | 321 |
| 1439 | 50,800 | 50,800 | 0.5 | 340 |
| 1441 | 58,740 | 58,060 | 3.5 | 185 |
| 1451 | 54,860 | 49,370 | 2.5 | 187 |
| 1452 | 55,270 | 48,500 | 2.5 | 187 |
| Illium 98 | 54,000 | 41,000 | 18 | 149 |
| Illium B | 61,000 | 60,000 | 0.5–1.5 | 240–290 |
| 3,758,296 | 57,000 | 56,000 | 0–1 | 255–440 |

EXAMPLE 2

Without heat treatment, the corrosion test bars were machined into 1½ inch diameter by ¼ inch thick discs, each having ⅛inch diameter hole in the center. These discs were carefully machined to size, polished to a 600-grit finish, pickled 5 hours in 35% nitric acid at 80° C. to remove any dust, cutting oil or foreign matter, rinsed in water and dried. Each cleaned disc was weighed to the nearest 10,000th of a gram and then suspended in a flask by a platinum wire hooked through the center hole of the disc and attached to the top of the flask. Sufficient 97% sulfuric acid was then added to the beaker so that the disc was completely immersed in the acid and a fitted, water cooled sealed top was installed. The temperature of the acid was maintained at various temperatures from 80° C. to 130° C. by means of a hot plate.

The corrosion tests were conducted for 48 hours; however, every six hours the test discs were moved to different flasks containing fresh acid which had been brought to the desired temperature. After 48 hours, the discs were removed from the sulfuric acid and cleaned of corrosion products. Most samples were cleaned sufficiently with a nylon brush and tap water. Samples on which the corrosion products were too heavy for removal with the brush were cleaned with a 1:1 solution of hydrochloric acid and water. After the corrosion products had been removed, each disc was dried and weighed again to the nearest 10,000th of a gram. The results of these tests are set forth in Table III.

The corrosion rate for each disc, in mils per year, was calculated in accordance with the formula:

$$R_{mpy} = 393.7 \frac{W_o - W_f}{ATD}$$

where $R_{mpy}$=corrosion rate in mils per year $W_o$=original weight of sample in grams $W_f$=final weight of sample in grams A=area of sample in square cm T=duration of test in years D=density of alloy in gm/cc In the corrosion data the units employed to measure corrosion depth were mils. On mil equals 0.001 inch. The rate of corrosion attack is expressed in mils per year (M.P.Y.).

The commercial machine shop employed to machine tee discs was unable to prepare discs from the Johnson U.S. Pat. No. 3,758,296 alloy. Therefore, the results set forth are taken directly from that patent.

TABLE III

CORROSION RATE IN MILS OF PENETRATION PER YEAR IN 97% SULFURIC ACID AT VARIOUS TEMPERATURES

| ALLOY DESIGNATION | 80° C. | 90° C. | 100° C. | 110° C. | 120° C. | 130° C. |
|---|---|---|---|---|---|---|
| 1430 | 1.5 | 2.4 | 5.1 | 10.7 | 34.2 | 102.2 |
| 1431 | 1.3 | 1.9 | 3.8 | 7.7 | 23.1 | 76.2 |
| 1437 | 0.4 | 0.6 | 1.0 | 2.1 | 5.7 | 14.2 |
| 1438 | 0.8 | 0.9 | 1.6 | 3.4 | 8.8 | 26.1 |
| 1439 | 0.6 | 0.8 | 1.2 | 2.8 | 7.2 | 20.2 |
| 1441 | 0.9 | 1.5 | 2.8 | 6.5 | 18.0 | 59.0 |
| 1451 | 1.1 | 1.5 | 2.5 | 5.7 | 16.0 | 54.0 |
| 1452 | 1.1 | 1.7 | 3.0 | 7.1 | 20.2 | 63.3 |
| Illium 98 | 2.0 | 5.0 | 10.7 | 21.1 | 39.0 | 87.1 |
| Illium B | 1.1 | 2.1 | 3.8 | 8.4 | 19.5 | 58.3 |
| 3,758,296 | 10–11 | NT | NT | NT | 9–22 | NT |

NT = Not tested

In some applications 20 MPY or even 30 MPY corrosion rate may be tolerated, but a 10 MPY maximum rate of attack is more realistic for many valve and pump parts and where contamination is to be minimal. The most preferred composition of alloys of this invention contain about 3.55% Si and could meet any corrosive situation for which the long-established Illium B has been found suitable while still maintaining relatively good tensile elongation and ductility. If even more severe conditions are to encountered the less preferred higher-Si alloys may be employed but at the expense of increased difficulty of machining and handling. In alloys of this sort under the same conditions of exposure to 97% sulfuric acid except for temperature variations, there would be no reason to think the attack rate of the Johnson alloy would be any less at any temperature between those given. Therefore, the alloys of the present invention may be seen to equal or surpass the performance of the Johnson alloy over the entire temperature range.

As various changes can be made in the above alloy without departing from the scope of the invention, it is intended that all matter contained in the above description shall be interpreted as illustrative and not in a limiting sense.

What is claimed is:

1. A Nickel-Chromium-Iron alloy consisting essentially of the following in approximately the percentage ranges by weight indicated:

| | |
|---|---|
| Ni | 36–40.5 |
| Cr | 31–33 |
| Mo | 4–5.2 |
| Cu | 2.7–4 |
| Si | 2.5–6 |
| N | 0.40–0.62 |
| Co | up to 1.2 |
| Fe | balance |

2. An alloy of claim 1 containing up to 2% manganese and up to 0.11% carbon, both by weight.

3. An alloy of claim 2 containing about 31–32.5% chromium, 3–4.3% silicon, 0.5–0.6% nitrogen, up to 0.9% carbon, up to 1% manganese, and 15–23.1% iron.

4. An alloy of claim 3 containing 36–39% nickel, copper, 3.2–3.9% silicon, 0.2–1% manganese, and iron.

5. A Nickel-Chromium-Iron alloy consisting essentially of the following in approximately the percentage ranges by weight indicated:

| | |
|---|---|
| Ni | 36.5–38.5 |
| Cr | 31–32 |
| Mo | 4–5 |
| Cu | 3–3.5 |
| Si | 3.4–3.7 |
| N | 0.5–0.6 |
| C | to 0.08 |
| Mn | 0.3–0.8 |
| Co | to 1 |
| Fe | 17–21.3 |

6. An alloy of claim 5 containing 37.5% nickel, 31.5% chromium, 4.5% molybdenum, 3.1% copper, 3.55% silicon, 0.55% nitrogen, 0.05% carbon, 0.5% manganese, and the balance essentially iron.

* * * * *

UNITED STATES PATENT AND TRADEMARK OFFICE

CERTIFICATE OF CORRECTION

PATENT NO. : 4,836,985

DATED : June 6, 1989

INVENTOR(S) : John H. Culling

It is certified that error appears in the above-identified patent and that said Letters Patent is hereby corrected as shown below:

Column 12, lines 1-2, "nickel, copper", should read ---nickel, 3-4% copper---.

Column 12, line 2, "and iron", should read ---and 17-22.1% iron---.

Signed and Sealed this

Tenth Day of March, 1992

*Attest:*

HARRY F. MANBECK, JR.

*Attesting Officer*

*Commissioner of Patents and Trademarks*